US009670028B1

(12) United States Patent
Pinto

(10) Patent No.: US 9,670,028 B1
(45) Date of Patent: Jun. 6, 2017

(54) TRIGGER OPERATED BRAKE FOR HANDHELD TAPE DISPENSER INCLUDING A BARBED SPOOL HOLDER

(71) Applicant: Philo Jefferson Pinto, Phoenix, AZ (US)

(72) Inventor: Philo Jefferson Pinto, Phoenix, AZ (US)

( * ) Notice: Subject to any disclaimer, the term of this patent is extended or adjusted under 35 U.S.C. 154(b) by 45 days.

(21) Appl. No.: 14/522,623

(22) Filed: Oct. 24, 2014

Related U.S. Application Data

(63) Continuation-in-part of application No. 12/913,365, filed on Oct. 27, 2010, now Pat. No. 8,893,941.

(51) Int. Cl.
*B26F 3/02* (2006.01)
*B65H 35/00* (2006.01)

(52) U.S. Cl.
CPC ..... *B65H 35/0033* (2013.01); *B65H 35/0073* (2013.01)

(58) Field of Classification Search
CPC ..... B65H 35/0033; B65H 2403/725
USPC ..... 225/82, 79, 61, 66, 87, 56
See application file for complete search history.

(56) References Cited

U.S. PATENT DOCUMENTS

| | | | | |
|---|---|---|---|---|
| 3,374,139 | A | 3/1968 | Fritzinger | |
| 3,969,181 | A * | 7/1976 | Seabold | B65H 37/007 15/104.94 |
| 4,718,971 | A * | 1/1988 | Summers | B65H 37/007 156/540 |
| 4,762,586 | A | 8/1988 | Wilkie | |
| 5,110,401 | A | 5/1992 | Huang | |
| 5,564,645 | A | 10/1996 | Lissoni | |
| 5,725,726 | A | 3/1998 | Yu | |
| 6,612,474 | B2 | 9/2003 | Shah | |
| 7,506,835 | B2 | 3/2009 | Huang | |
| 7,611,088 | B1 * | 11/2009 | Yu Chen | B65H 37/007 156/579 |
| 2008/0135179 | A1 * | 6/2008 | Bedard | B65H 35/0033 156/510 |

FOREIGN PATENT DOCUMENTS

| | | | |
|---|---|---|---|
| CA | 2685565 | 12/2008 | |
| EP | 0459654 A1 * | 12/1991 | B65H 35/0033 |

* cited by examiner

*Primary Examiner* — Omar Flores Sanchez

(74) *Attorney, Agent, or Firm* — Paul B. Heynssens Attorney at Law PLC

(57) ABSTRACT

A handheld dispenser of pressure sensitive adhesive tape comprising a handle and a rotating spool holder including a brake plate and holding a roll of pressure sensitive adhesive tape on the tape spool holder, and a cutting blade, an idler pulley, and a finger activated trigger stopping the motion of the tape supply reel by engaging the brake plate through actuating a lever coupling the brake plate and the trigger, thus stopping the dispensing of tape when the trigger is pressed by a finger.

12 Claims, 10 Drawing Sheets

TRIGGER OPERATED BRAKE FOR HANDHELD TAPE DISPENSER INCLUDING A BARBED SPOOL HOLDER

CROSS-REFERENCE TO RELATED APPLICATION

This is a continuation-in-part of application Ser. No. 12/913,365 filed Oct. 27, 2010, the contents of which are hereby incorporated by reference.

TECHNICAL FIELD

This description relates generally to handheld tape dispensers and more specifically to the dispensing mechanisms.

BACKGROUND

A common type of packaging is corrugated boxes. These packages are sealed prior to storage or shipment and much of the sealing is done with pressure sensitive adhesive tape, which is simply cellophane backed adhesive tape. Previously, while there are various types of hand held versions of dispensers for pressure sensitive tape, current designs employ a spatula and or a retractable cutter that protrudes via pressure being exerted on the spatula. This requires the user to apply a perfect balance of pressure to the spatula and toward the cutter and position the dispenser at the perfect angle. The desired result is a clean cut in the tape at the desired length applied to the package.

All too often, if the balance of pressure and the angle is not correct, the result is the tape cut being longer than the desired length or a cut that is frayed by the jagged cutting blade. Moreover, the various manufactures of pressure sensitive tape have different strengths of adhesive, different tape materials, and different thicknesses resulting in variability that changes the user's technique to yield an acceptable cut.

U.S. Pat. No. 4,762,586 to Wilkie (1988) has a manually operated trigger that operates the cutter, but does not lock the roll of tape. If the cutter isn't applied just right, the tape will continue to dispense, resulting in excess tape with a less than perfect cut.

Prior art also includes various adjuncts such as U.S. Pat. No. 7,506,835B2 to Huong (2009) and U.S. Pat. No. 5,110,401A Huang (1992) and U.S. Pat. No. 5,564,645 to Lissoni (1996) that apply friction to the tape reel to maintain a uniform tension. This approach is helpful to keep the tape taut while applying the tape around the right angles of the container, but doesn't positively stop the tape for cutting. There is a delicate balance of how much tension to put the spool holding the roll of tape. With too little tension, the tape roll continues spinning after the cut because of the sudden loss of tension. When the tape roll spins, the tape unravels and becomes entangled. When this occurs, the user must locate the end of the tape on the roll and rethread it through the dispenser. Conversely, with too much tension on the tape reel, it requires excessive effort to dispense the tape. To complicate matters worse, the amount of effort to dispense the tape changes as the diameter of the roll changes. That is, the roll gets smaller as the tape is consumed.

The tape brake in U.S. Pat. No. 6,612,474B2 to Shah (2003) is suitable for a narrow tape dispenser common in an office environment. It relies on the strength of the user's two fingers to stop the dispensing of the tape. Furthermore, since it requires the user's hand to reach around the roll of tape, it is not practical for rolls with larger diameter or width such as the two inch wide tape used to close packages.

U.S. Pat. No. 3,374,139 to Fritzinger (1964) named Tape Dispenser with Hand Brake, applies variable pressure to increase tension or stop the dispensing of the tape. This mechanical design is very complex and relatively expensive to manufacture. This is evident by the lack of widespread commercialization.

Moreover, it often requires the user to exert increasing pressure as the desire for more tension increases. Lastly, the means used to increase tension and stop the tape when it comes in direct contact with the adhesive side of the tape thereby adversely affecting the strength of the adhesive and increasing the propensity to jamb or become tangled.

Accordingly, several objects and advantages of the invention are the ability of the user to decisively choose the exact point to terminate and then cut the tape. This is achieved with a single finger operated trigger that is accessible with the same hand that is holding the tape dispenser. Because of the slow speed the tape unwinds and the brake is sudden not gradual. With the dispensing of the tape halted, the user can then perform the cut at the desired point thus eliminated "run on" tape.

With the reel and supply roll positively stopped, the tape supply cannot keep spinning and tangle thus eliminating wasted tape. Additionally, there are fewer instances of tape becoming tangled eliminating the need to rethread the tape in the dispenser thus decreasing work stoppages and increasing productivity.

The advantage of a sudden stop is the same low strength effort is required to stop the tape from dispensing irrespective of tape thickness, materials, or quantity of the remaining tape on the roll. That is, the effort doesn't change as the size of the tape supply roll changes when it gets smaller as the tape is consumed. Moreover, the different types of tapes vary as to thickness and strength of material. The variability in materials will not change the effort required to depress the trigger and positively stop the tape from dispensing.

Positively stopping the dispensing of tape will also compensate for a dull cutting blade. That is, the dispenser will perform consistently when the cutting blade degrades.

The design of the tape break mechanism has fewer moving parts than its and is simpler to manufacture than previous devices that tension or stop the tape from dispensing. Moreover, the design uses the same simple procedure to load the tape as contemporary tape dispensers. The trigger and braking mechanism is contained within the contemporary design rendering it less vulnerable to destruction if dropped.

Further objects and advantages will become apparent from a consideration of the ensuring description.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

In accordance with the invention, this device overcomes many shortcomings of prior versions of hand held pressure sensitive tape dispensers inasmuch as it has a user operated trigger that stops the tape reel from turning and allows a precise cut of the tape with less skill and effort. Furthermore, it tends to substantially reduce the instances of the tape becoming entangled in the dispenser and tends to reduce the need to rethread the tape.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Figure 1:
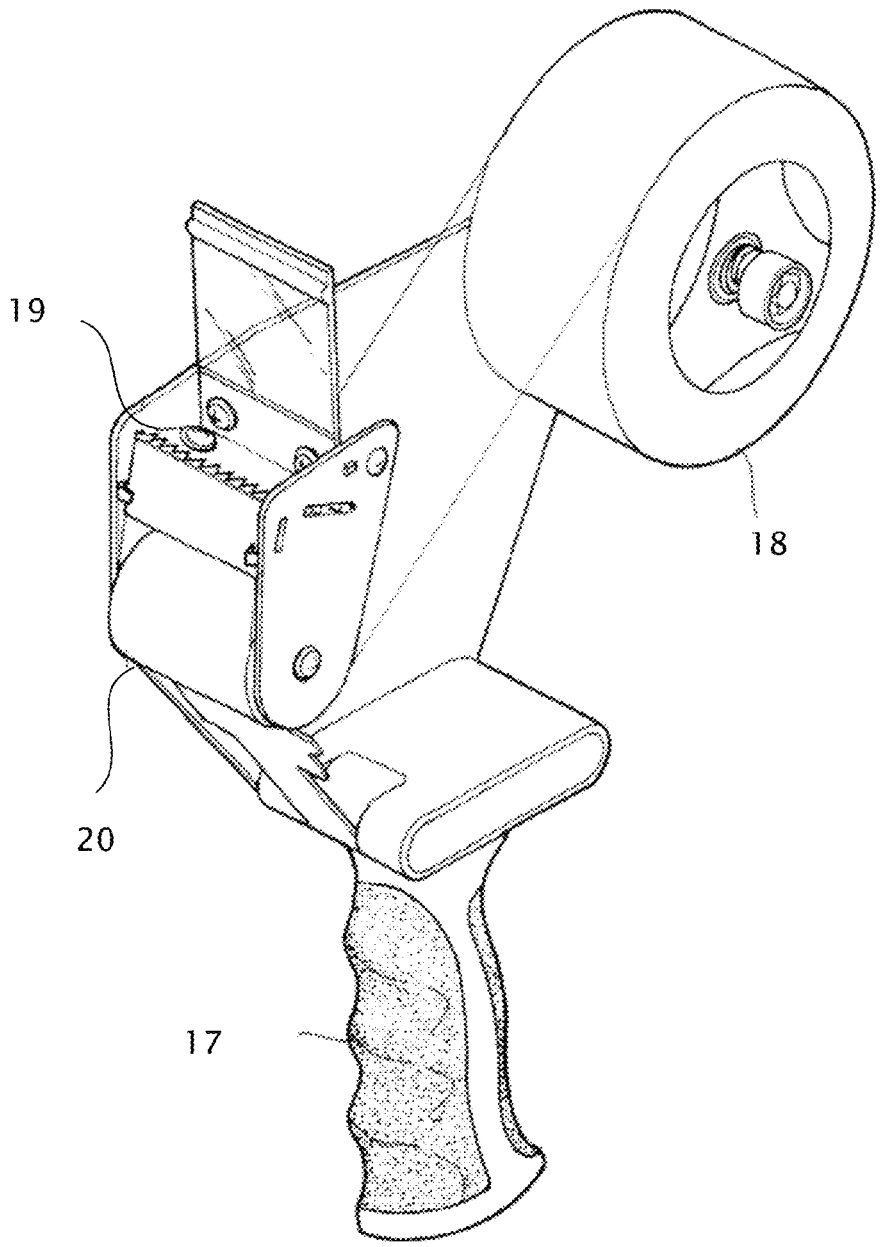
PRIOR ART FIG. 1
FIG. 1. is an illustration of a conventional hand held pressure sensitive tape dispenser.

FIG. 1 is a depiction of a conventional handheld pressure sensitive tape dispenser. The dispenser is provided with a handle 17 and a tape supply reel 18. The pressure sensitive tape supply is threaded from the reel 18 over an idler pulley 20 and behind the cutting blade 19.

Figure 2:
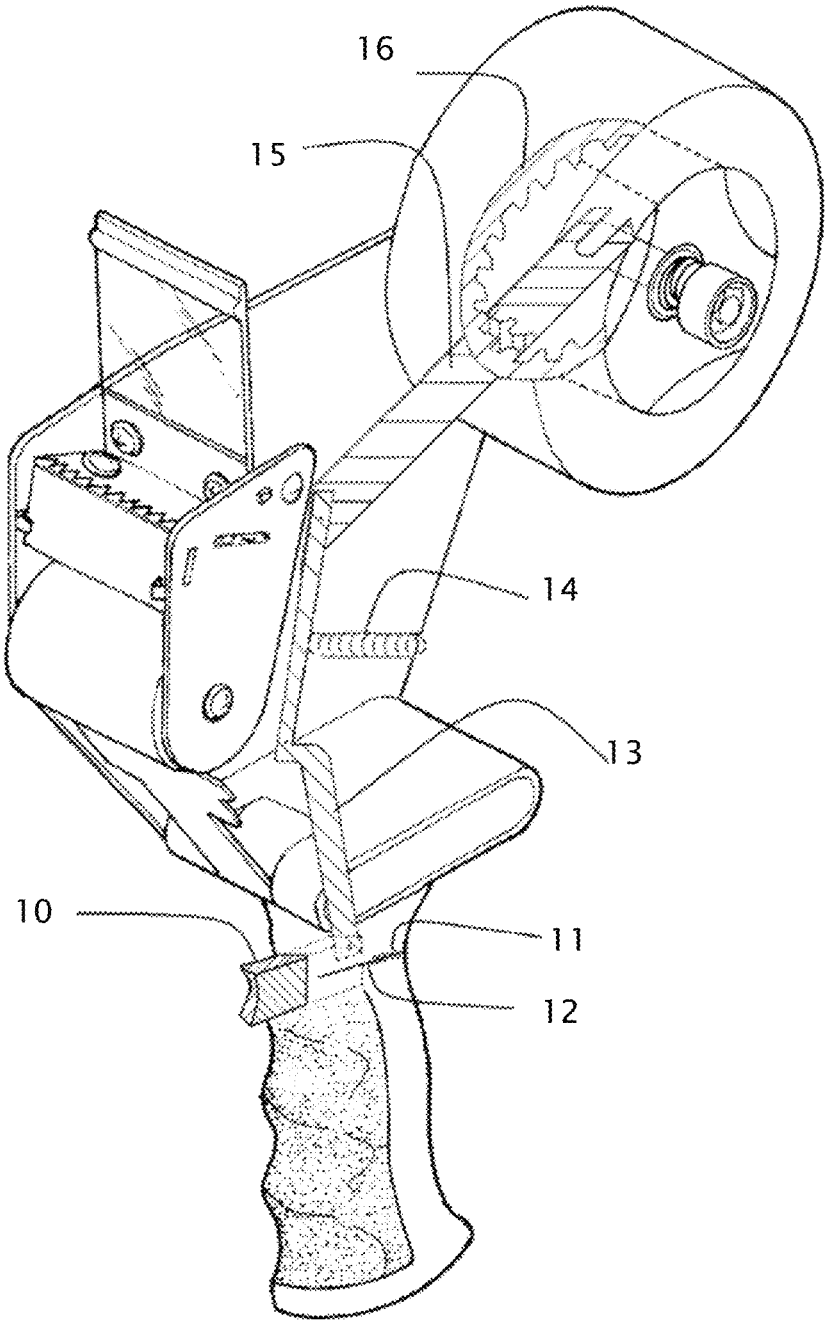
FIG. 2. is a perspective of the left side of the present example of a tape dispenser with a trigger operated brake.

FIG. 2. is a perspective of the left side of the present example of a tape dispenser with a trigger operated brake. As the tape is dispensed, the cogged spool holder 16 rotates counter clockwise. When the desired amount of tape has been dispensed, the user depresses the trigger 10. The trigger 10 has a trigger guide rod 11 and a trigger return spring 12 to ensure smooth and consistent movement.

The trigger 10 pushes the lever 13 and the lever pulls the brake plate 15. A raised portion of the brake plate 15 bearing curved teeth, slides into the curved teeth on the rotating spool holder 16. The curved shape of the teeth on the brake plate 15 and the spool holder 16 allows the cogs to mesh together quickly and immediately stop the spool holder 16 from turning, thus stopping the dispensing of the tape. The user then exerts force to stretch the tape over the cutting blade 19 to cut the tape.

After the cut is complete, the user releases the trigger 10, thereby permitting the trigger return spring 12 to restore the trigger to its normal position. The lever return spring 14 returns the lever 13 to its ready to use position and retracts the brake plate 15 teeth from the teeth of the spool holder 16. The user may also stop the dispensing of tape to increase tension and release the trigger without cutting the tape.

Figure 3A:
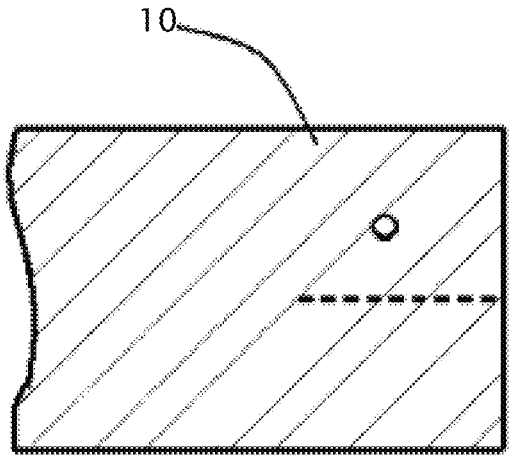
FIG. 3A. is a left side view of the trigger

FIG. 3A. is a left side view of the trigger 10.

Figure 3B:
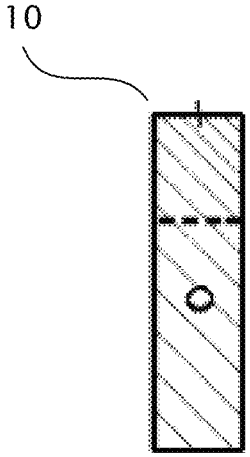
FIG. 3B. is the rear side of the trigger.

FIG. 3B. is the rear side of the trigger 10.

Figure 4A:
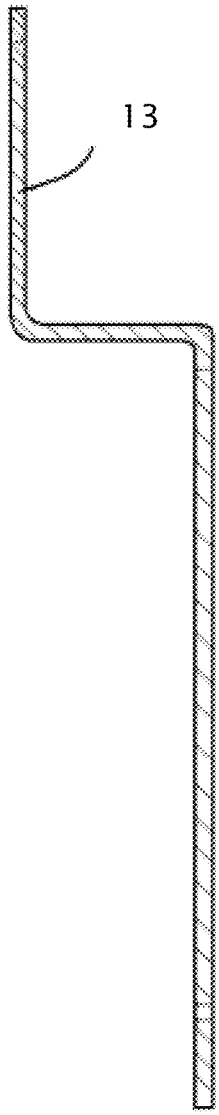
FIG. 4A. is the rear view of the lever.

FIG. 4A. is the rear view of the lever 13.

Figure 4B:
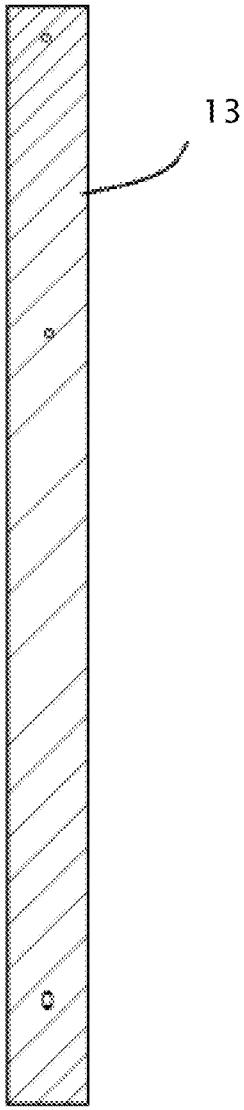
FIG. 4B. is the side view of the Lever.

FIG. 4B. is the side view of the lever 13.

Figure 5A:
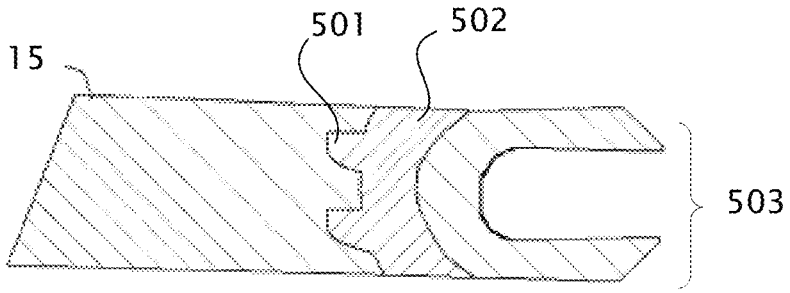
FIG. 5A. is the top view of the brake plate.

FIG. 5A. is the top view of the brake plate 15. The plate 15 may be made of metal or equivalent material. The plate is generally planar with a raised portion 502 provided, in which one or more teeth 501 are disposed. A forked area 503 is provided to couple to an axle holding the cogged spool holder to a handle assembly (not shown). Alternatively an aperture, such as an oblong opening, may be provided to allow the teeth to engage the cogs (not shown).

Figure 5B:
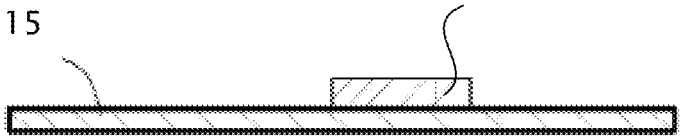
FIG. 5B. is the side view of the brake plate.

FIG. 5B. is the side view of the brake plate 15. The brake plate 15 is substantially flat with a raised portion 502. The raised portion 502 may be formed from the same piece, or may be a separate piece that is attached to the flat portion.

Figure 6A:
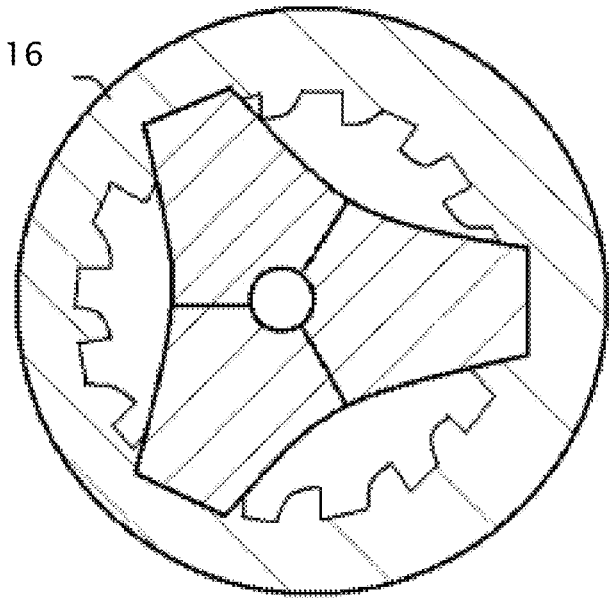
FIG. 6A. is the side view of the cogged spool holder.

FIG. 6A. is the side view of the cogged spool holder 16.

Figure 6B:
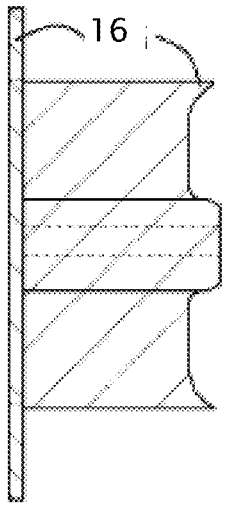
FIG. 6B. is the rear view of the cogged spool holder.

FIG. 6B. is the rear view of the cogged spool holder 16.

Figure 7:
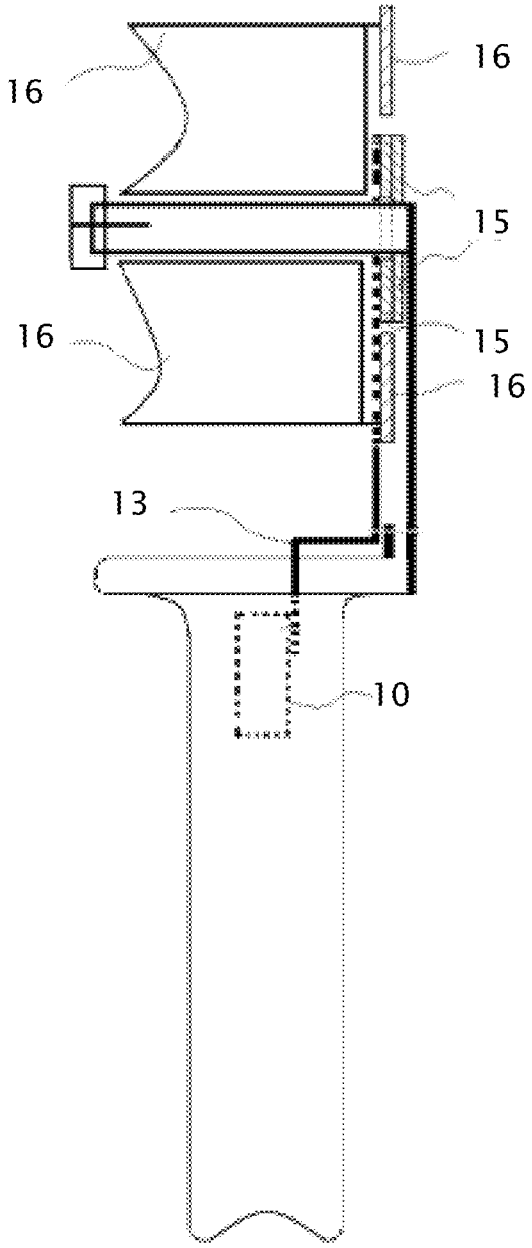
FIG. 7. is the rear cutaway view of the present example.

FIG. 7. is a rear cutaway view of the present example.

Figure 8:
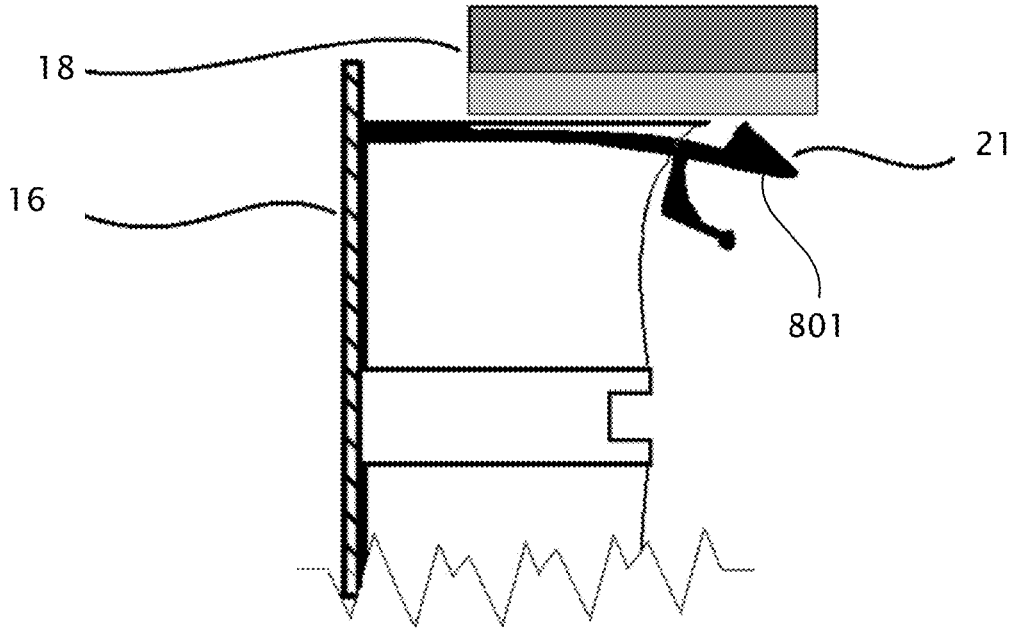
FIG. 8 depicts a roll of pressure sensitive tape being installed onto an alternate example of having a flexible retaining clip (barbed) spool holder.

FIG. 8 depicts a tape supply reel 18 being installed onto a cogged spool holder 16 of the present example. As the tape supply reel is installed onto the cogged spool holder 16, one of a plurality of flexible retaining clips 21 deflect to allow the tape supply roll 18 to be seated into place.

Since the tape supply reel is loaded from one side and held in place on the cogged spool holder 16 by friction, the tape supply reel can potentially slip off or become misaligned on the spool holder during tape dispensing. When the spool of tape is not fully seated on the spool holder it pulls at an angle, creates creases, and can become entangled in the dispenser. The flexible retaining clips prevent the tape supply reel from disengaging the cogged spool holder or becoming misaligned. Barbs 801 help prevent spool movement as they snap over the rim of the reel when it is installed, and may easily be pushed inwards to release the spool.

Figure 9:
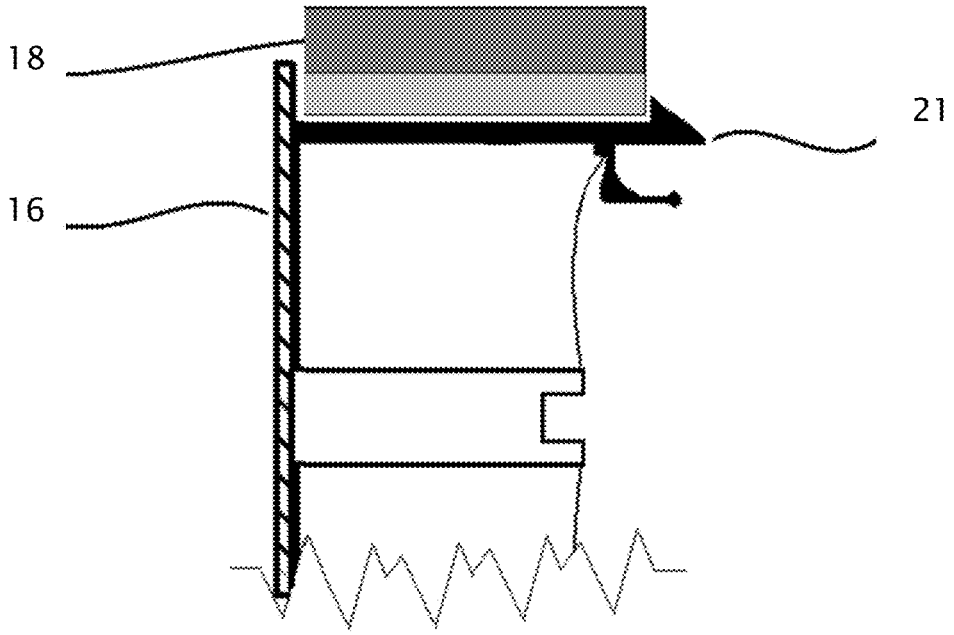
FIG. 9 depicts a roll of pressure sensitive tape after installation onto the cogged spool holder with the flexible retaining clip fully engaging the tape supply reel 18.

FIG. 9 depicts a roll of pressure sensitive tape after installation onto the cogged spool holder of the present example, with one of a plurality of the flexible retaining clips fully engaging the tape supply reel 18. Once the tape supply reel 18 is seated in place on the cogged spool holder 16, the flexible retaining clips 21 spring back to their normal position to hold the tape supply roll 18 firmly in alignment with the cogged spool holder and prevent the tape supply roll from disengaging, becoming misaligned, or "walking off" the spool holder.

When the tape supply reel is depleted of tape, the remaining cardboard liner is removed from the cogged spool holder by pressing inward on the flexible retaining clips 21 and subsequently sliding the remaining cardboard liner off the cogged spool holder 16.

Figure 10:
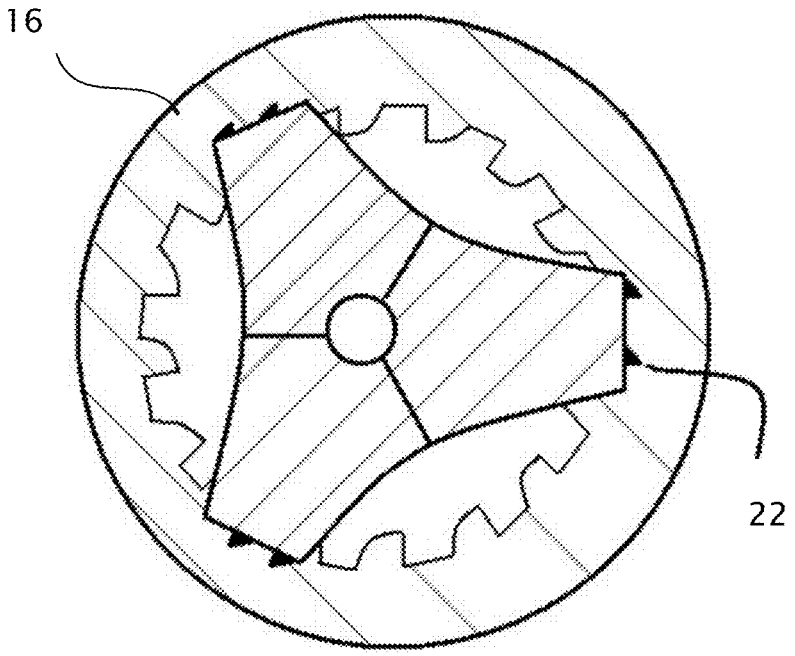
FIG. 10 shows a side view of a cogged spool holder with anti-slip barbs.

FIG. 10 shows a side view of a cogged spool holder with anti-slip barbs. As tape is dispensed, the cogged spool holder 16 rotates counterclockwise. The anti-slip barbs may be angled in such a way as to engage the cardboard (or equivalent) liner, or core, of the tape supply reel (not shown).

Full reels of tape generally have sufficient rigidity to maintain their engagement with a cogged spool holder without anti-slip barbs; however, as the tape is consumed, the roll of tape loses rigidity and henceforth traction on the spool holder, allowing it to spin independently of the spool holder. The anti-slip barbs 22 "bite" into or otherwise engagedly couple the cardboard liner of the tape supply reel preventing it from turning independently of the cogged spool holder, thereby allowing the brake (not shown) when applied, to completely stop the dispensing of tape. The trilobular spool holder is shown with two barbs per lobe. Equivalently any convenient number of barbs may be provided on the lobes, and all lobes do not necessarily have to have equal numbers of barbs, Those skilled in the art will recognize that the present examples provide a substantially easier to use and a more reliable means to dispense and cut pressure sensitive tape from a hand held dispenser. Furthermore, the trigger operated brake for a handheld tape dispenser has additional advantages of

- it decisively permits the cut off of the tape when the user chooses via a trigger;
- it substantially reduces the need to untangle and rethread the tape;
- it uses a small quantity of strength to operate the trigger from a single finger from the same hand to operate;
- it works consistently with different thicknesses of tape;
- it works consistently with different quantities of tape on a tape reel;
- it is substantially simpler, has fewer moving parts, and is less expensive to manufacture than previous tape brakes;
- it can also be used to stop the tape to add additional tension when going around the corners of a box;
- it can positively engage the tape reel to prevent misalignment or loss of the tape reel.

While the above description contains many specificities, these should not be construed as limitations on the scope of the invention, but as exemplifications of the presently preferred embodiments thereof. Many other ramifications and variations are possible within the teachings of the invention. For example, range of motion of the trigger, length of the lever, the size and shape of the brake plate and the size and shape of the cogged spool holder.

Thus the scope of the invention should be determined by the appended claims and their legal equivalents, and not by the examples given.

The invention claimed is:

1. A handheld dispenser of pressure sensitive adhesive tape comprising:

a handle, and a rotating spool holder including a brake plate, holding a roll of tape on the spool holder by a plurality of flexible retaining clips;

a cutting blade;

an idler pulley; and a trigger stopping the motion of the tape supply reel holder by engaging the brake plate through actuating a lever coupling the brake plate and the trigger, thus stopping the dispensing of tape when the trigger is pressed by a finger;

wherein the brake plate interlocks with teeth disposed in the spool holder to prevent it from turning; and wherein the toothed brake plate engages a plurality of teeth disposed about an interior circumference of the rotating spool holder.

2. The handheld dispenser of pressure sensitive adhesive tape of claim 1, wherein the device includes a spring biased trigger which is coupled to the lever.

3. The handheld dispenser of pressure sensitive adhesive tape of claim 1, wherein the lever is coupled to the brake plate, the brake plate being toothed.

4. The handheld dispenser of pressure sensitive adhesive tape of claim 1, wherein the plurality of flexible retaining clips are disposed about the outer circumference of the rotating spool holder.

5. The handheld dispenser of pressure sensitive adhesive tape of claim 1, wherein the plurality of flexible retaining clips include a barbed end.

6. A tape dispenser comprising:

a cogged spool holder rotating as tape is dispensed;

a trigger coupled to a toothed brake plate such that when the trigger is actuated the toothed brake plate engagedly couples the cogged spool holder stopping the dispensing of tape, in which the toothed brake plate includes a raised portion having at least one tooth for engaging the cogged spool holder is disposed.

7. The tape dispenser of claim 6, in which the trigger is configured to tension the tape without actuating a cutter to cut the tape.

8. The tape dispenser of claim 6, further comprising a spring bias to return the trigger to its original position when the trigger is released.

9. The tape dispenser of claim 6, in which the toothed brake plate includes a forked portion for engaging an axle of the cogged spool holder.

10. The tape dispenser of claim 6, in which the cogged spool holder includes a plurality of flexible retaining clips to hold a tape supply real on the cogged spool holder.

11. The tape dispenser of claim 10, in which the plurality of flexible retaining clips include a barbed end at an end of a flexible shaft.

12. The tape dispenser of claim 11, in which the flexible shaft deflects when a tape supply reel is installed on the cogged spool holder, with the barb snapping in place to secure the tape supply real during use.

* * * * *